US012692697B2

(12) United States Patent
Smith et al.

(10) Patent No.: US 12,692,697 B2
(45) Date of Patent: Jul. 28, 2026

(54) FIBER-REINFORCED POLYMER WALL FRAMING SYSTEM

(71) Applicant: Fiber Frame Incorporated, Airdrie (CA)

(72) Inventors: Kyle Smith, Calgary (CA); Clinton Harrowing, Airdrie (CA)

(73) Assignee: Fiber Frame Incorporated, Airdrie (CA)

( * ) Notice: Subject to any disclaimer, the term of this patent is extended or adjusted under 35 U.S.C. 154(b) by 167 days.

(21) Appl. No.: 18/776,303

(22) Filed: Jul. 18, 2024

(65) Prior Publication Data

US 2026/0022556 A1 Jan. 22, 2026

(51) Int. Cl.
*E04B 2/56* (2006.01)

(52) U.S. Cl.
CPC ..... *E04B 2/56* (2013.01)

(58) Field of Classification Search
CPC ..... E04B 2/56; E04B 1/28; E04B 2001/389; E04C 3/28; E04C 3/36
See application file for complete search history.

(56) References Cited

U.S. PATENT DOCUMENTS 5,065,556 A * 11/1991 DeLong ..... H02G 3/288 52/239
5,394,665 A 3/1995 Johnson
5,930,968 A * 8/1999 Pullam ..... E04B 2/7457 52/690
6,490,841 B2 * 12/2002 Hynes ..... E04C 3/29 403/403
7,690,167 B2 * 4/2010 Antonic ..... E04C 3/29 52/489.1
8,327,596 B2 * 12/2012 Bratton ..... E04B 1/28 403/255
10,787,829 B1 * 9/2020 Meyer ..... E04H 1/02
2002/0148191 A1 * 10/2002 Hynes ..... E04C 3/29 52/838
2007/0028555 A1 2/2007 Juenemann
2007/0137134 A1 * 6/2007 Plagemann ..... B29C 70/52 52/656.9
2008/0159807 A1 7/2008 Andrews
2010/0186346 A1 * 7/2010 Bratton ..... E04C 3/28 403/205
2018/0274236 A1 * 9/2018 Singleton ..... E04C 3/28
2022/0064942 A1 * 3/2022 Inglese ..... E04B 1/12
2022/0064951 A1 * 3/2022 Inglese ..... E04C 2/22

FOREIGN PATENT DOCUMENTS

WO 2015101582 7/2015

OTHER PUBLICATIONS

International Written Opinion of the International Searching Authority for International Application No. PCT/IB2025/054984, mailed Aug. 22, 2025.

* cited by examiner

*Primary Examiner* — Gisele D Ford
(74) *Attorney, Agent, or Firm* — Lewellyn Law, PLLC; Stephen Lewellyn

(57) ABSTRACT

A fiber-reinforced polymer wall system includes a plurality of wall framing components and joint components that can be assembled into a wall frame. The wall framing components can include stud members, rail members, and header members. The joint components can include joints of three different configurations for attaching the framing components to constructed a desired wall frame.

12 Claims, 17 Drawing Sheets

FIBER-REINFORCED POLYMER WALL FRAMING SYSTEM

FIELD OF THE INVENTION

The invention relates generally to wall construction and, more particularly, to a fiber-reinforced polymer (FRP) wall framing system.

BACKGROUND OF THE INVENTION

Composite construction materials made of fiber-reinforced polymer (FRP) are well-known. FRP construction materials are increasingly replacing conventional construction materials (e.g., wood, steel) due to their lightweight nature, strength, and ease of manufacturing. Despite the advantages, there are many problems with the currently available products. Some of these problems reside in the shape of the building materials, and other problems are found in how the products are joined to construct walls.

Standard FRP shapes used to frame walls comprise elongated members having a C-shaped cross-section and an I-shaped cross-section. Typically, the C-shaped members are used as the bottom and top rails of the wall between which the I-shaped members are used as studs, with the ends of the studs inserted into the channel of the C-shaped rails. This construction creates several problems. First, this construction creates a gap between the wall studs and the wallboard because of the thickness of the C-shaped rail. Another problem is joining the ends of abutted rails (walls) at a corner or end-to-end. Typically, two abutted C-shaped rails are joined by lapping another C-shaped rail on top and screwing into the thin flanges of the rails, creating a weak fraying surface that can be easily sheared. Another problem caused by this joint is a weak bearing surface to roof joists sitting on top of the turned-over C-shaped rail.

Yet another problem exists in window or door framing wherein the construction members are weakly joined due to the inherent problems with the C-shaped and I-shaped members discussed above. Typically, conventional building materials such as wood are used to frame wall openings, undermining an FRP-constructed wall's intent.

Accordingly, an FRP wall framing system that overcomes the disadvantages of existing FRP wall framing members is needed and desired.

SUMMARY OF THE INVENTION

It is an object of embodiments of the invention to provide a fiber-reinforced polymer (FPR) wall system that overcomes the disadvantages in now existing wall framing systems.

It is an object of embodiments of the invention to provide an FPR wall framing system that is versatile for constructing walls of various configurations.

It is an object of embodiments of the invention to provide an FPR wall system wherein standard wallboard products may be attached flush with wall studs without gaps between the wallboard and the studs.

It is an object of embodiments of the invention to provide an FPR wall system wherein top plates can be connected end-to-end without a double top plate construction.

It is an object of embodiments of the invention to provide an FPR wall system wherein top plates can be connected in a butt joint without a double top plate construction.

It is an object of embodiments of the invention to provide an FPR wall system wherein top plates provide increased bearing surface area for floor joists or roof trusses.

It is an object of embodiments of the invention to provide an FPR wall system wherein fiber-reinforced polymer components are entirely used in framing wall openings.

It is an object of embodiments of the invention to provide a plate member that is mostly hollow to be lightweight, but with a structural internal lattice to disperse concentrated compression loads and/or tension loads, for instance from stud bearing or from roof truss uplift respectively.

In some aspects, a fiber-reinforced wall system may have plurality of six components of different structural shapes that can be used to construct walls of various configurations.

In some aspects, a fiber-reinforced wall system may have a plurality of wall framing components, including stud members, rail members, and header members.

In some aspects, a fiber-reinforced polymer wall system may have three different joint members that may be used to connect the wall framing components in the construction of a wall with the framing components.

In some aspects, a fiber-reinforced polymer wall system may have a plurality of wall framing members comprising of rail members, stud members, and first joint members. The rail members and stud members may be connected by the first joint members to frame a wall with the stud members attached to and extending between the rail members in spaced relationship along the rail members.

In some aspects, each rail member may have a length, a first broad planer surface, an opposite second broad planer surface, a first side, an opposite second side, and first and second slots formed through the first surface and extend along the rail member.

In some aspects, each rail member may have third and fourth slots formed through the second surface and extending along the rail member.

In some aspects, each stud member may have opposite ends, a length extending between the opposite ends, a web and a pair of flanges on opposite sides of the web, and each flange has a passage at the opposite ends.

In some aspects, the first joint member may have a web, first and second flanges extending in opposite directions from the web at a first end, and third and fourth flanges extending in opposite directions from the web at a second end, and wherein the first joint members are configured to connect the ends of the stud members to the rail members.

In some aspects, the fiber-reinforced polymer wall system may have second joint members. In some aspects, the second joint members may have a central web first and second flanges extending in opposite directions from the web at a first end, and third and fourth flanges extending in opposite directions from the web at a second end, the first and third flanges are disposed in an inwardly direction from first and second ends, respectively, and the second and fourth disposed in an inwardly direction from first and second ends, respectively, at greater distance than first and third flanges such that second and fourth flanges are inwardly offset from first and third flanges.

In some aspects, the fiber-reinforced polymer wall system may have third joint members, In some aspects, the third joint members may have a web, first and second flanges extending in the same direction from the web, the first flange inwardly disposed from a first end, the second flange inwardly disposed from a second end, and channel disposed on a side of the web opposite the first and second flanges that is defined by first and second walls attached to the web.

In some aspects, the fiber-reinforced polymer wall system wherein the plurality of framing members may further have header members. In aspects, the header members may have a pair of legs extending outwardly in the same direction from opposite ends of a web, a first slot formed through a first leg and extends along a length of the header, a second slot formed through the other leg and extends along the length of the header, a first channel formed in web through a first outward facing side in a direction perpendicular to the first leg and extends along the length of the header, and a second channel formed in web through a second outward facing side in a direction perpendicular to second leg and extends along the length of the header.

In some aspects, a fiber-reinforced polymer wall assembly may have at least two rail members and at least one stud member. Each rail member may have a length, a first broad planer surface, an opposite second broad planer surface, a first side, an opposite second side, and first and second slots formed through the first surface and extend along the rail member. Each stud member may have opposite ends, a length extending between the opposite ends, a web and a pair of flanges on opposite sides of the web, each flange having a passage at the opposite ends. The stud member extends between the rail members and is connected at its opposite ends to the rail members by a separate joint member at each end with the joint member disposed in the passages of the stud flanges and in the first and second slots of a respective rail member. And an outermost surface of each flange of the stud member is flush with an outermost surface of each of the first and second sides of each rail member.

Numerous additional objects, features, and advantages of the present invention will be readily apparent to those of ordinary skill in the art upon a reading of the following detailed description of presently preferred but illustrative embodiments of the present invention when taken in conjunction with the accompanying drawings. The invention is not limited to a single application but is capable of various embodiments and of being practiced and carried out in numerous ways. Also, it is to be understood that the phraseology and terminology employed herein are for descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages, and the specific objects attained by its uses, reference should be made to the accompanying drawings and descriptive matter in which there are illustrated embodiments of the invention.

BRIEF DESCRIPTION OF THE DRAWINGS

The following drawings illustrate by way of example and are included to provide a further understanding of the invention for illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized, and changes can be made without departing from the scope of the disclosure.

Figure 1:
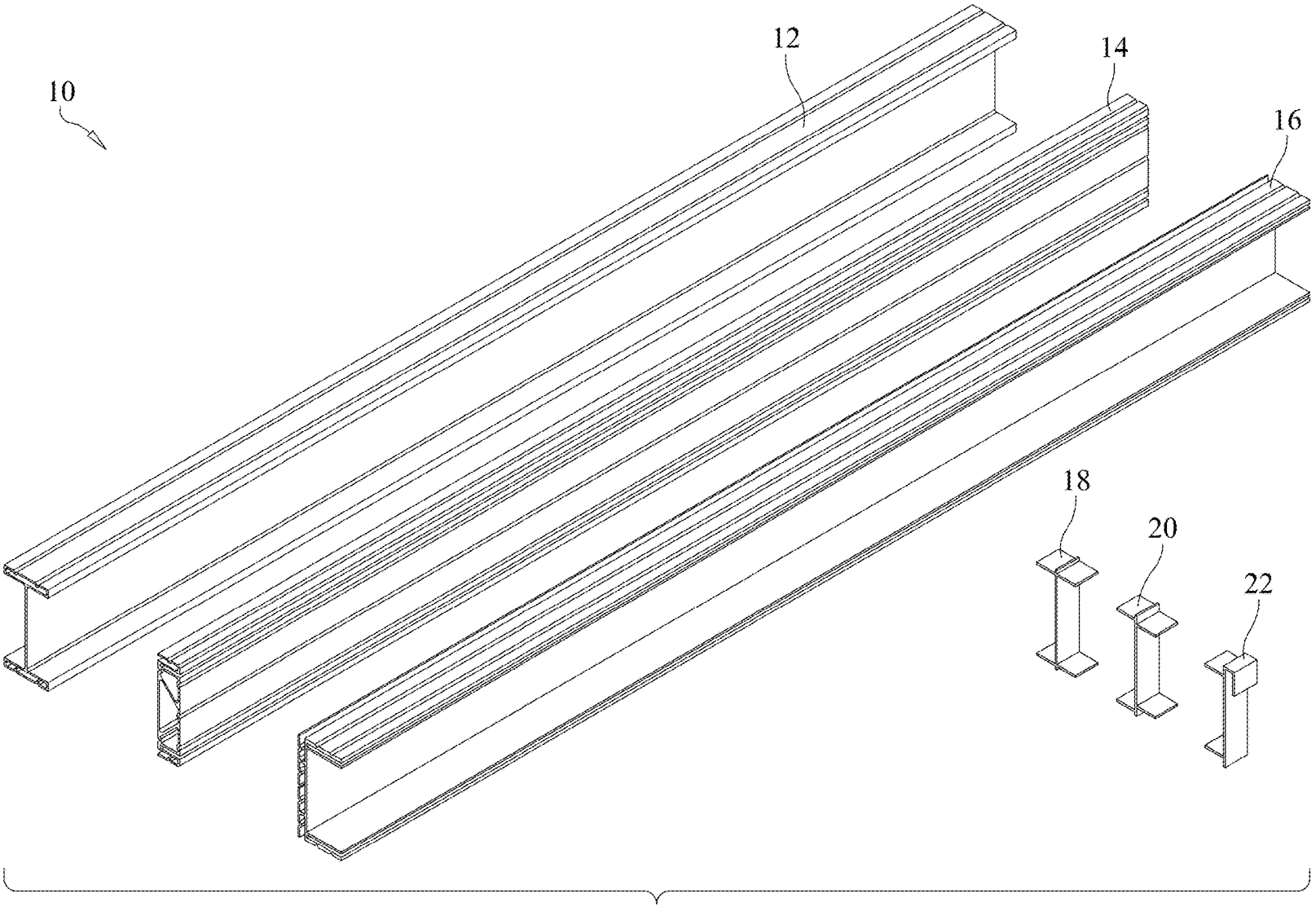
FIG. 1 is a diagrammatic illustration of wall framing components of a wall framing system according to an aspect of the invention.

FIG. 1 is a diagrammatic illustration of wall framing components of a wall framing system 10 according to an aspect of the invention. As representatively shown, in an aspect, the system 10 may have a stud member 12, a rail member 14, a header member 16, and joint members 18-22. Members 12-22 may be constructed from fiber-reinforced polymer using known methods, such as extrusion.

Figure 2:
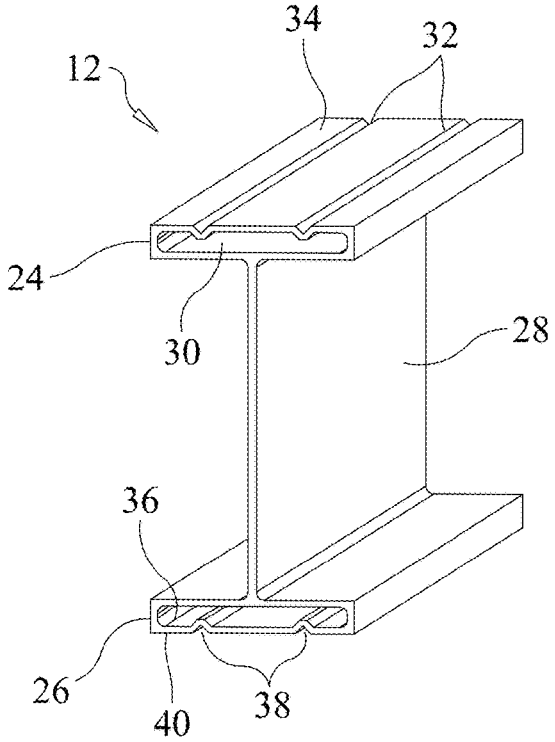
FIG. 2 is a diagrammatic, perspective view of a stud wall framing component of a wall framing system according to an aspect of the invention.
Figure 3:
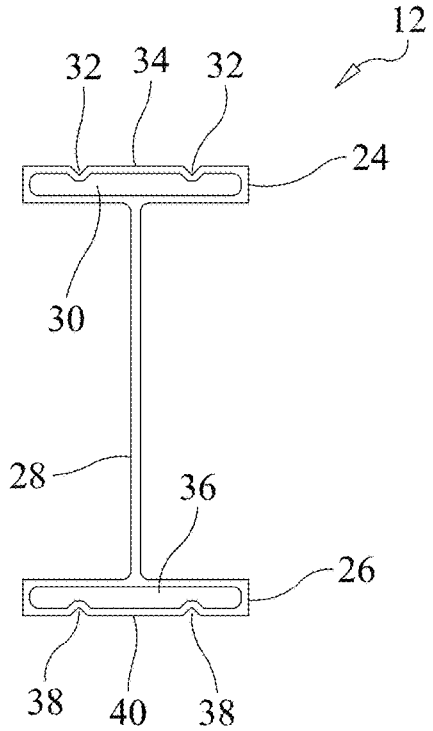
FIG. 3 is a diagrammatic, end view of the stud wall framing component of FIG. 2.

With reference to FIGS. 2 and 3, a stud member 12 is shown in accordance with an aspect of the invention. Stud member 12 is an elongated member with a generally I-shaped cross-section with opposite flanges 24 and 26 and a web 28 extending along the lengths of the flanges. Flange 24 has an internal passage 30 extending along its length, and a pair of spaced grooves 32 formed into an outward-facing surface 34, extending the length of the flange. Flange 26 has an internal passage 36 extending along its length and a pair of spaced grooves 38 formed in an outward-facing surface 40, extending the length of the flange. As described below, passages 30 and 36 are configured to receive a coupling member, such as member 18 or 20 when attaching the stud member. Channels 32 and 38 are configured to receive threaded fasteners when securing the stud member to the coupling member, with the head of the fasteners recessed below the outward-facing surfaces 34 and 40.

Figure 4:
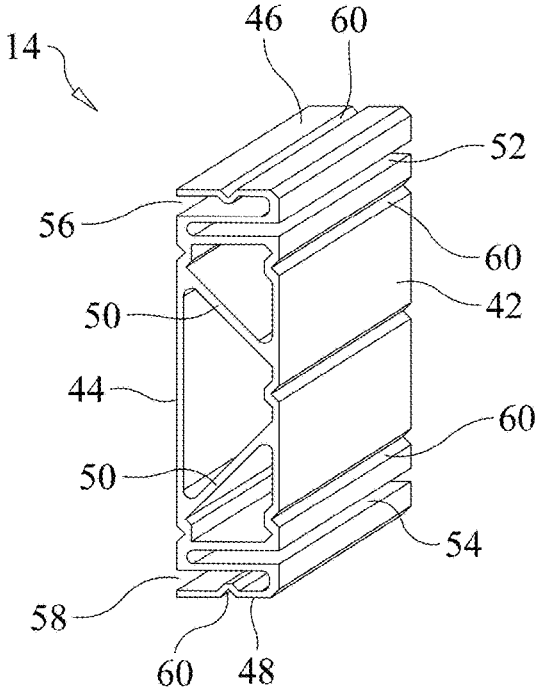
FIG. 4 is a diagrammatic, perspective view of a rail wall framing component of a wall framing system according to an aspect of the invention.
Figure 5:
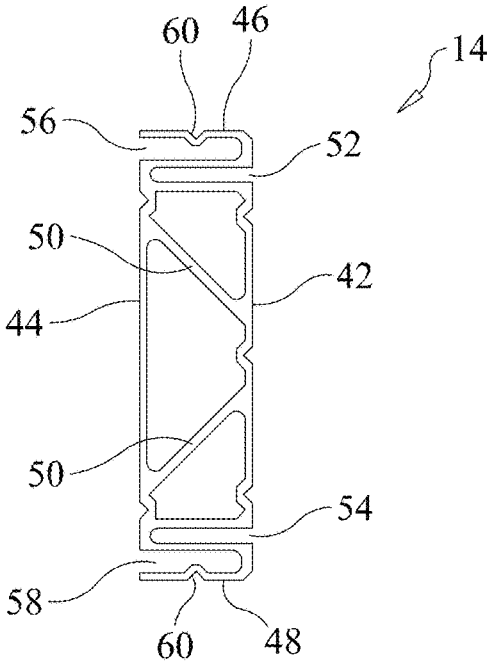
FIG. 5 is a diagrammatic, end view of the rail wall framing component of FIG. 5.

With reference to FIGS. 4 and 5, rail member 14 is shown in accordance with an aspect of the invention. Rail member 14 is an elongated member with a generally rectangular-shaped cross-section. In an aspect, rail member 14 can be used as a sill plate and a top plate in a wall framing. In another aspect, rail member 14 may be used as a jack stud in framing wall openings. As representatively shown, rail member 14 has a first broad planer surface 42 and an opposite second broad planer surface 44, a first side 46, and an opposite side 48. Rail member 14 has a generally hollow interior extending along its length is which is disposed webbing 50 providing structural support. Rail member 14 has first and second slots 52 and 54 formed through the first surface 42 and extending the length of the rail member. Rail member 14 has third and fourth slots 56 and 58 formed through the second surface 44 and extending the length of the rail member. As further shown, rail member has a plurality of fastener grooves 60 formed into its sides and surfaces. As described below, slots 52 and 54 and slots 56 and 58 are used in connecting the rail member 14 with other wall framing components during wall framing by one or more of the coupling members 18-22 depending on the joint.

Figure 6:
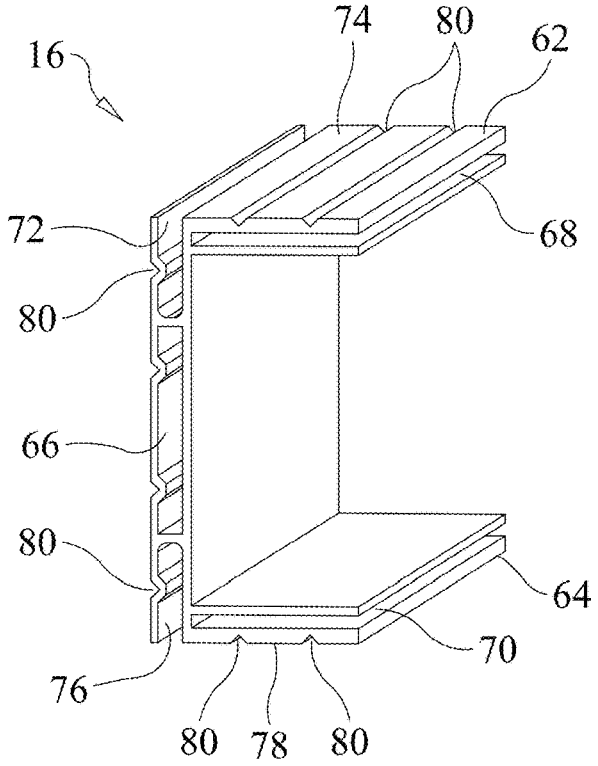
FIG. 6 is a diagrammatic, perspective view of a header wall framing component of a wall framing system according to an aspect of the invention.
Figure 7:
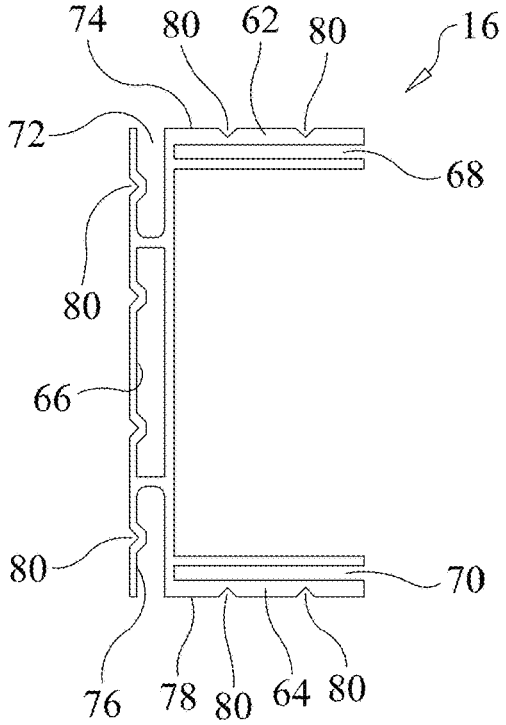
FIG. 7 is a diagrammatic, end view of the header wall framing component of FIG. 6.

With reference to FIGS. 6 and 7, header member 16 is shown in accordance with an aspect of the invention. Header member 16 is an elongated member with a generally L-shaped cross-section. In an aspect, header member 16 can be used in forming a header in framing wall openings. Header 16 has a pair of legs 62 and 64 extending outwardly in the same direction from opposite ends of a web 66. A slot 68 is formed through leg 62 and extends along the length of the header. A slot 70 is formed through leg 64 and extends along the length of the header. Header 16 has channel 72 formed in web 66 through outward facing side 74 in a direction perpendicular to leg 62 and extends along the length of the header. Header 16 as a second channel 76 formed in web 66 through outward facing side 78 in a direction perpendicular to leg 64 and extends along the length of the header. As further shown, header member 16 has a plurality of fastener grooves 80 formed into its sides and surfaces. As described below, slots 68 and 70 and channels 72 and 76 are used in connecting the header member 14 with other wall framing components during wall framing by one or more of the coupling members 18-22 depending on the joint.

Figure 8:
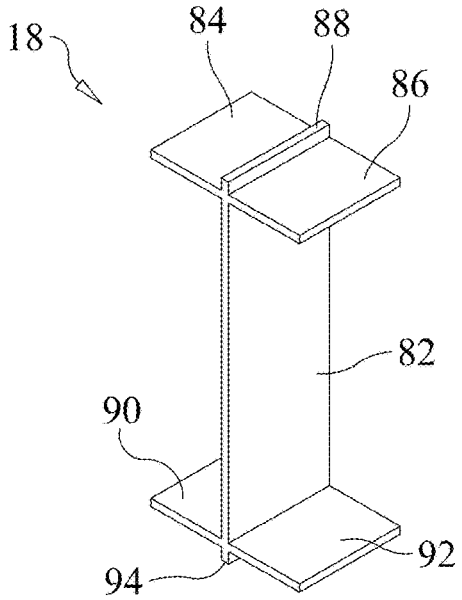
FIG. 8 is a diagrammatic, perspective view of a first joint wall framing component of a wall framing system according to an aspect of the invention.
Figure 9:
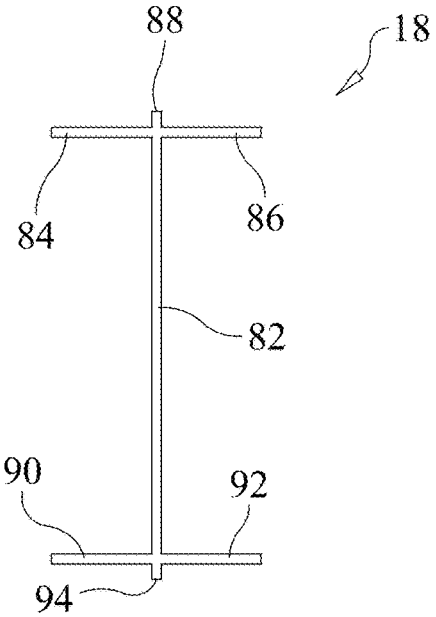
FIG. 9 is a diagrammatic, end view of the first joint framing component of FIG. 8.

With reference to FIGS. 8 and 9, a first joint member 18 is shown in accordance with an aspect of the invention. Joint member 18 has a central web 82, first and second flanges 84 and 86 extending in opposite directions from the web at a first end 88, and third and fourth flanges 90 and 92 extending in opposite directions from the web at a second end 94. Flanges 84 and 86 are disposed in an inwardly direction from end 88 and flanges 90 and 92 are disposed in an inwardly direction from end 94.

Figure 10:
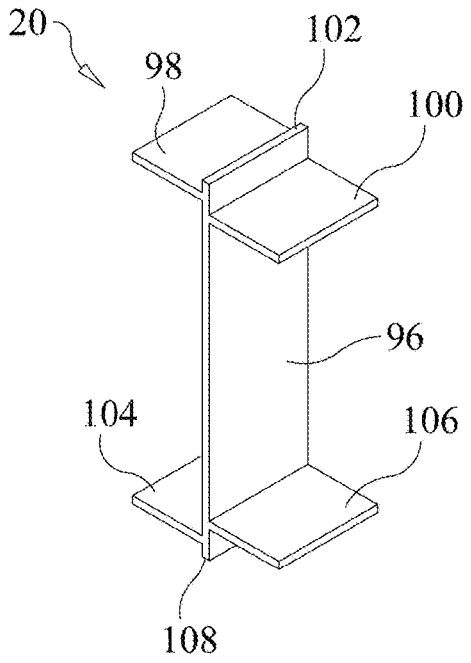
FIG. 10 is a diagrammatic, perspective view of a second joint wall framing component of a wall framing system according to an aspect of the invention.
Figure 11:
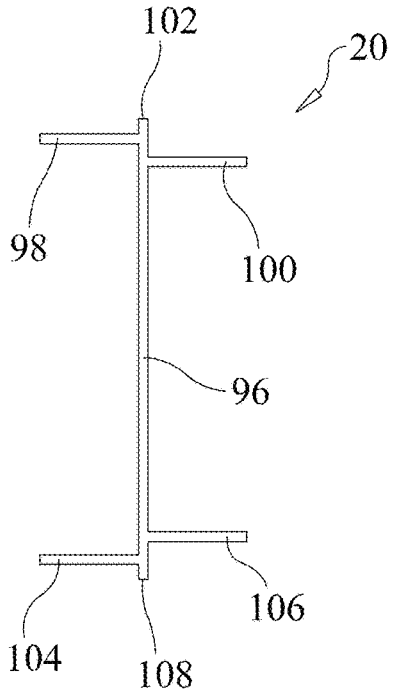
FIG. 11 is a diagrammatic, end view of the second joint framing component of FIG. 8.

With reference to FIGS. 10 and 11, a second joint member 20 is shown in accordance with an aspect of the invention. Joint member 20 has a central web 96, first and second flanges 98 and 100 extending in opposite directions from the web at a first end 102, and third and fourth flanges 104 and 106 extending in opposite directions from the web at a second end 108. Flanges 98 and 104 are disposed in an inwardly direction from ends 102 and 108, respectively, at a distance from their respective ends. Flanges 100 and 106 are disposed in an inwardly direction from ends 102 and 108, respectively, at greater distance than flanges 98 and 104 such that flanges 100 and 106 are inwardly offset from flanges 98 and 104.

Figure 12:
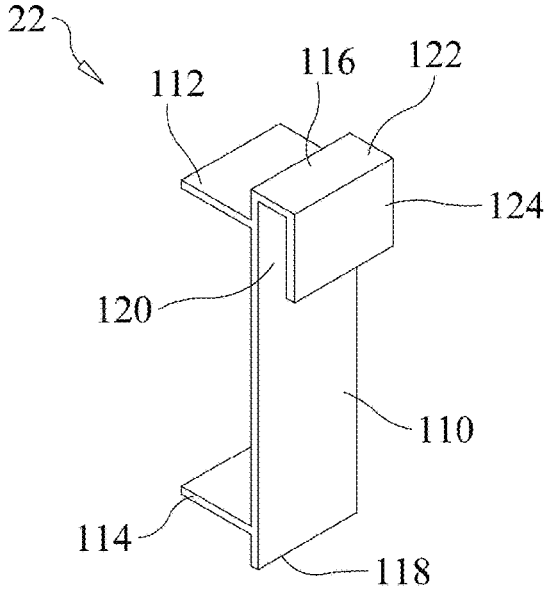
FIG. 12 is a diagrammatic, perspective view of a third joint wall framing component of a wall framing system according to an aspect of the invention.
Figure 13:
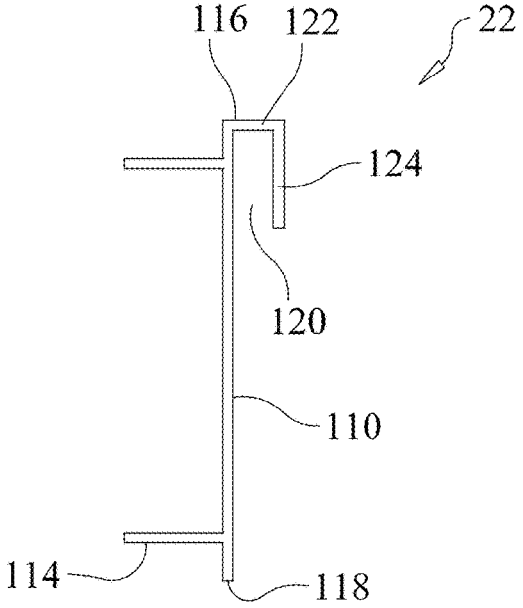
FIG. 13 is a diagrammatic, end view of the third joint framing component of FIG. 8.

With reference to FIGS. 12 and 13, a third joint member 22 is shown in accordance with an aspect of the invention. Joint member 22 has a central web 110 and first and second flanges 112 and 114 extending in the same direction from the web. Flange 112 is inwardly disposed from end 116, and flange 114 is inwardly disposed from end 118. Joint member 22 further has channel 120 disposed on the side of the web opposite flanges 112 and 114 and at end 116, defined by walls 122 and 124.

Figure 14:
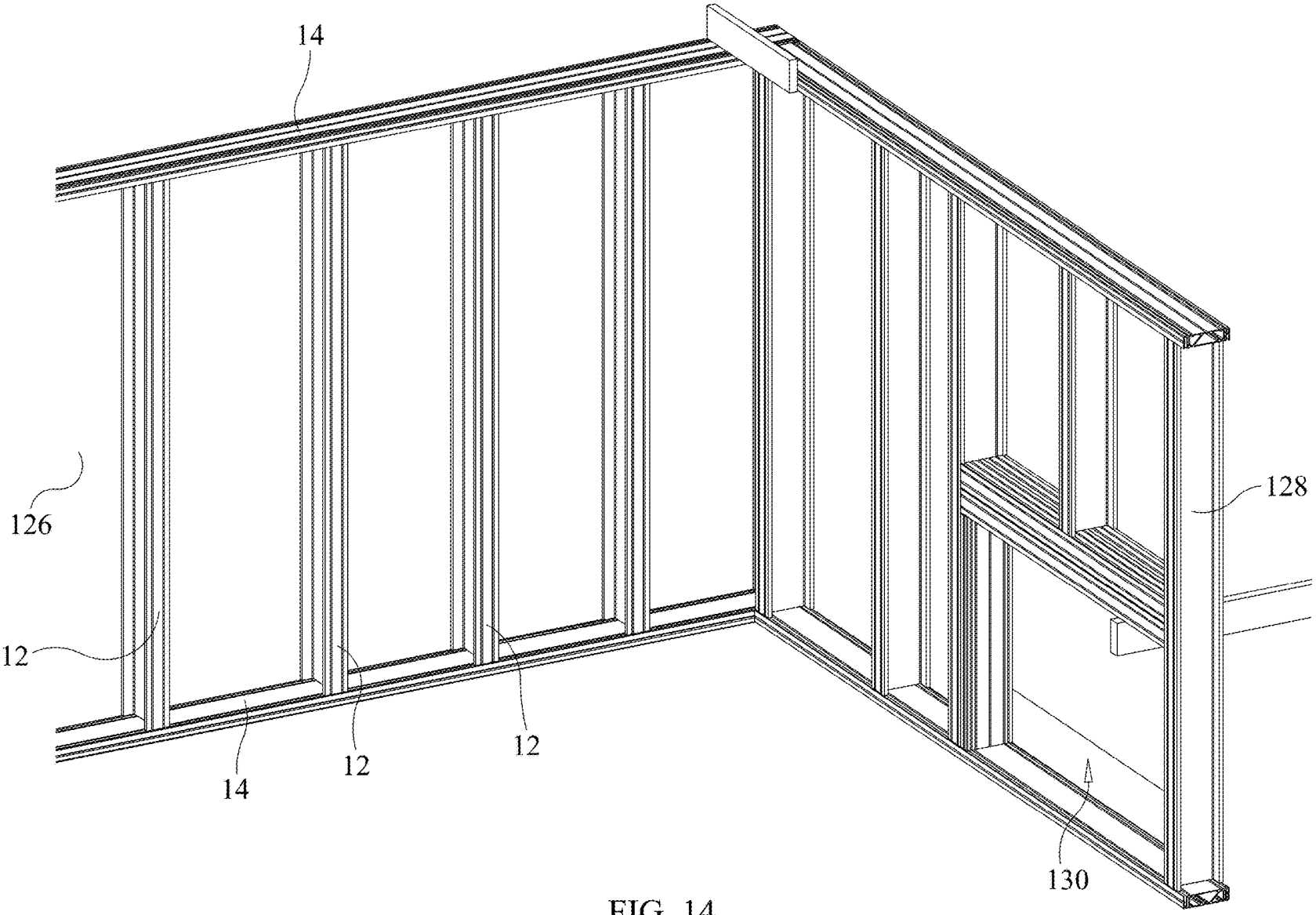
FIG. 14 is a diagrammatic, perspective view of a wall assembly constructed of the wall framing components of the wall framing system according to an aspect of the invention.

FIG. 14 shows a pair of walls 126 and 128 that are joined at an adjacent corner and constructed according to an aspect of the invention using the wall system 10. As representatively shown, walls 126 and 128 each have sill and top plates provided by rail members 14 and a plurality of spaced stud members 12 attached to and extending between the rail members. Wall 128 is shown with a representative framed wall opening 130, which will be described in further detail below.

Figure 15:
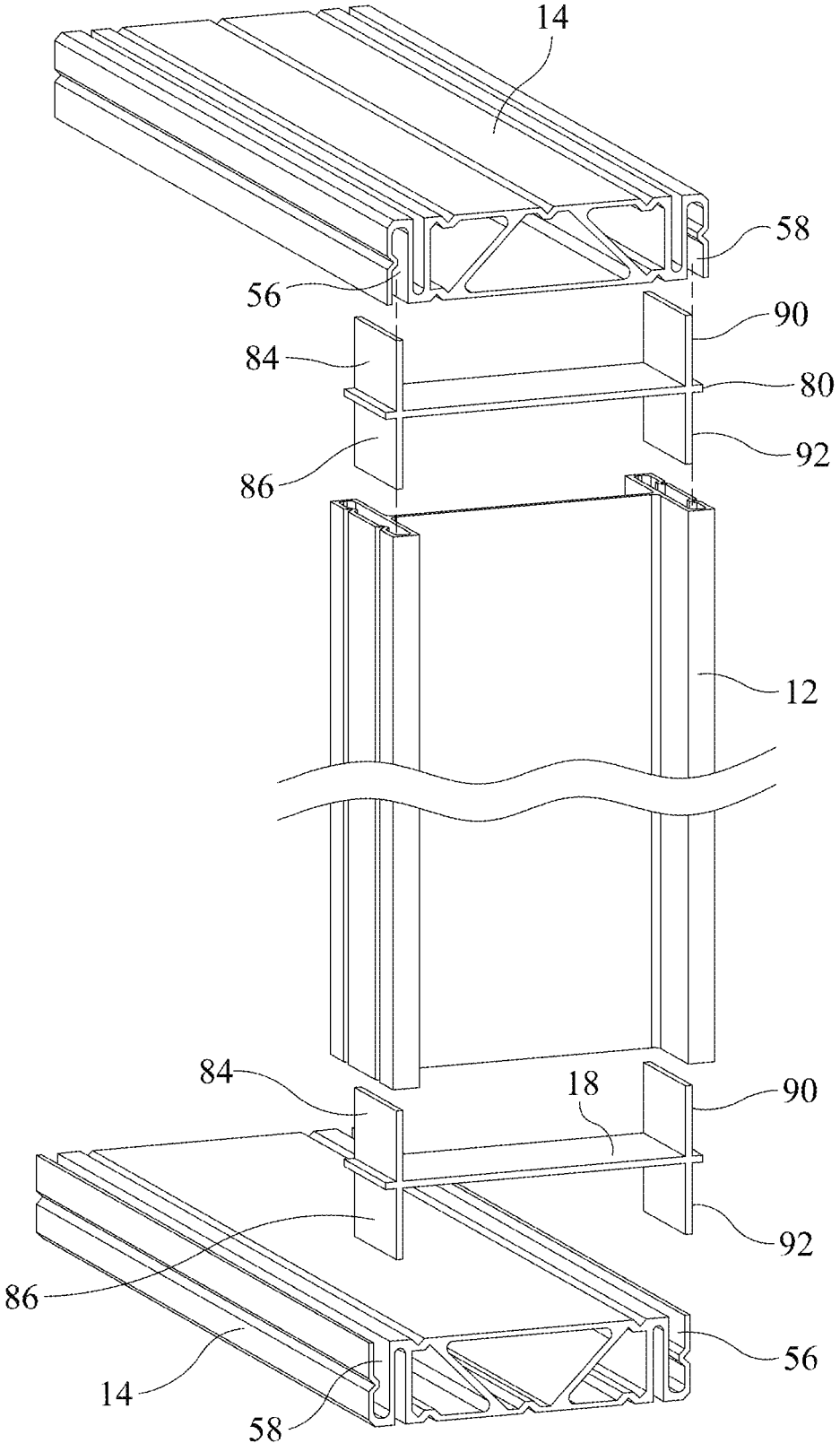
FIG. 15 is a diagrammatic, exploded view illustrating a connection between a stud member between two rail members, one as a top plate the other as sill plate, by first joint members in accordance with an aspect of the invention.
Figure 16:
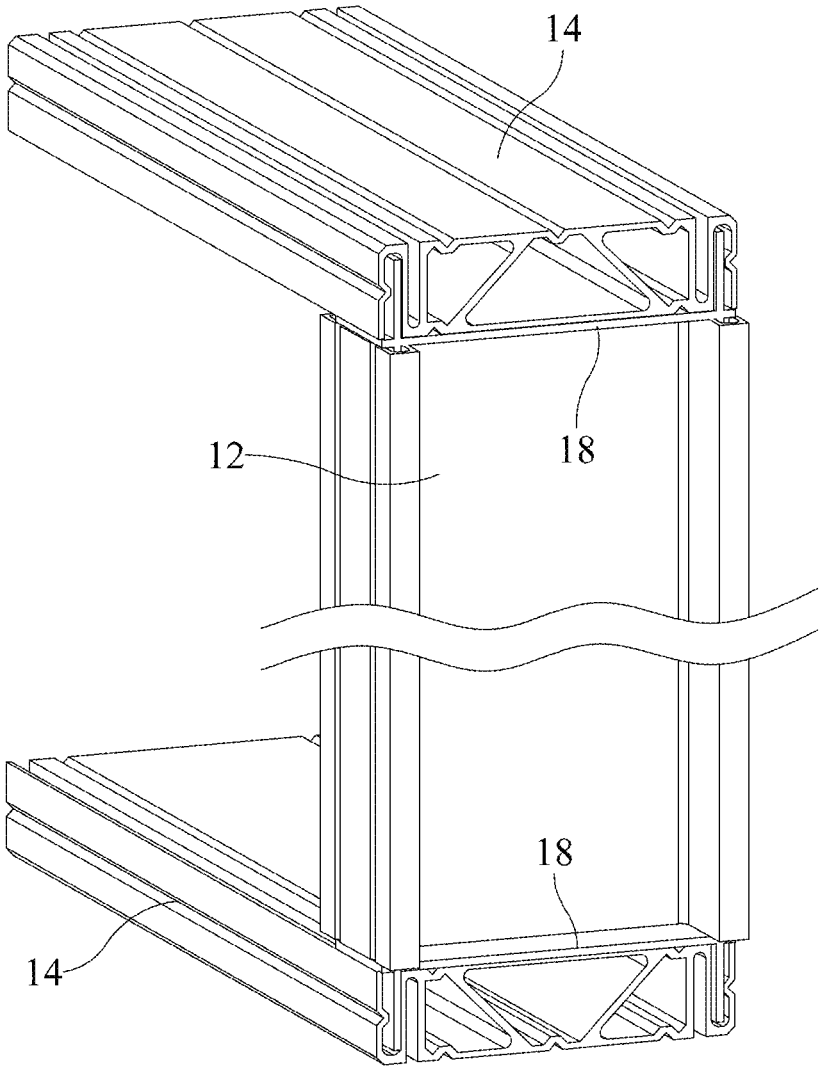
FIG. 16 is a diagrammatic view illustrating a stud member connected at its opposite ends to rail members by joint members.

FIG. 15 is a diagrammatic view illustrating a connection between a stud member 12 between two rail members 14, one as a top plate the other as sill plate, by joint members 18 in accordance with an aspect of the invention. As seen, flanges on one side of joint members 18 are received in corresponding slots 56, 58 of the rail members 14, and the flanges on the opposite side of the joint members are received in passages 30 and 36 of stud member 12 and secured with screws. FIG. 16 illustrates the stud member 12 connected at its opposite ends to the rail members 14 by joint members 18 and extending therebetween.

Figure 17:
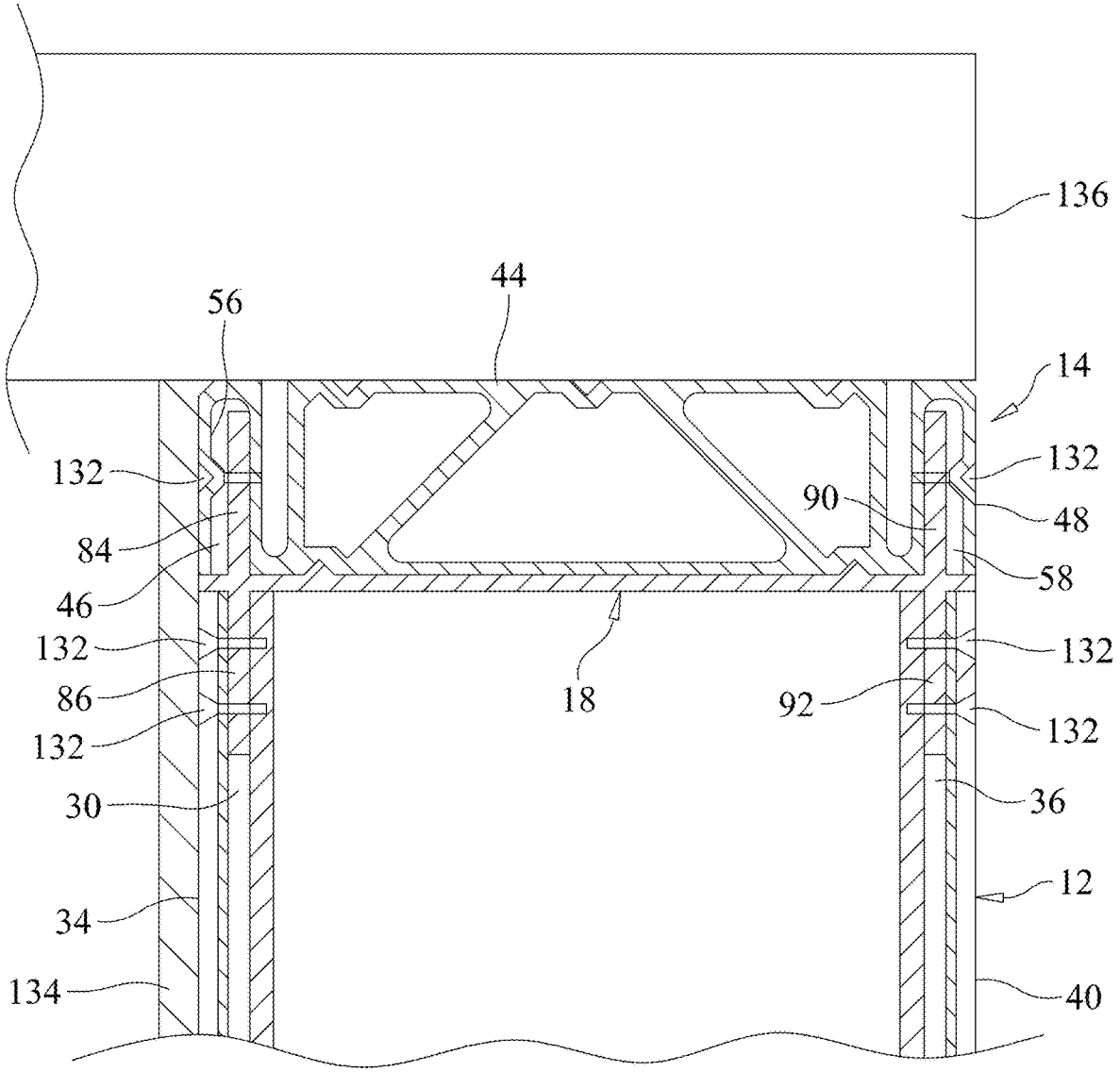
FIG. 17 is a diagrammatic, cross-sectional view through a wall constructed of wall framing components of the wall framing system according to an aspect of the invention.

FIG. 17 is a cross-sectional view through a wall diagrammatically showing a connection between a member 14 as a top plate of the wall and a stud member 12 by a first joint member 18 in accordance with an aspect of the invention. As representatively shown, flanges 84 and 90 of member 18 are disposed in slots 56 and 58, respectively, of member 14 and fastened together by screws 132. Further, flanges 86 and 92 of member 18 are disposed in passages 30 and 36, respectively, of stud member 12 and fastened together by screws 132. While not shown here, stud member 12 is similarly connected by joint member 18 at its opposite end to another member 18, providing a sill plate for the wall. Importantly, surfaces 34 and 40 of stud member 12 are flush with surfaces 46 and 48 of member 14, thereby eliminating the gap between wall board 134 and stud member and overcoming a disadvantage of existing FRP wall framing discussed previously. As further shown, a roof truss 136 is supported on member 18 along its surface 44, which provides a more bearing surface than a conventional C-shaped FRP member in now existing FRP wall framing, wherein the roof truss would merely be supported on the narrow edges of the upturned C-shaped FRP member.

Figure 18:
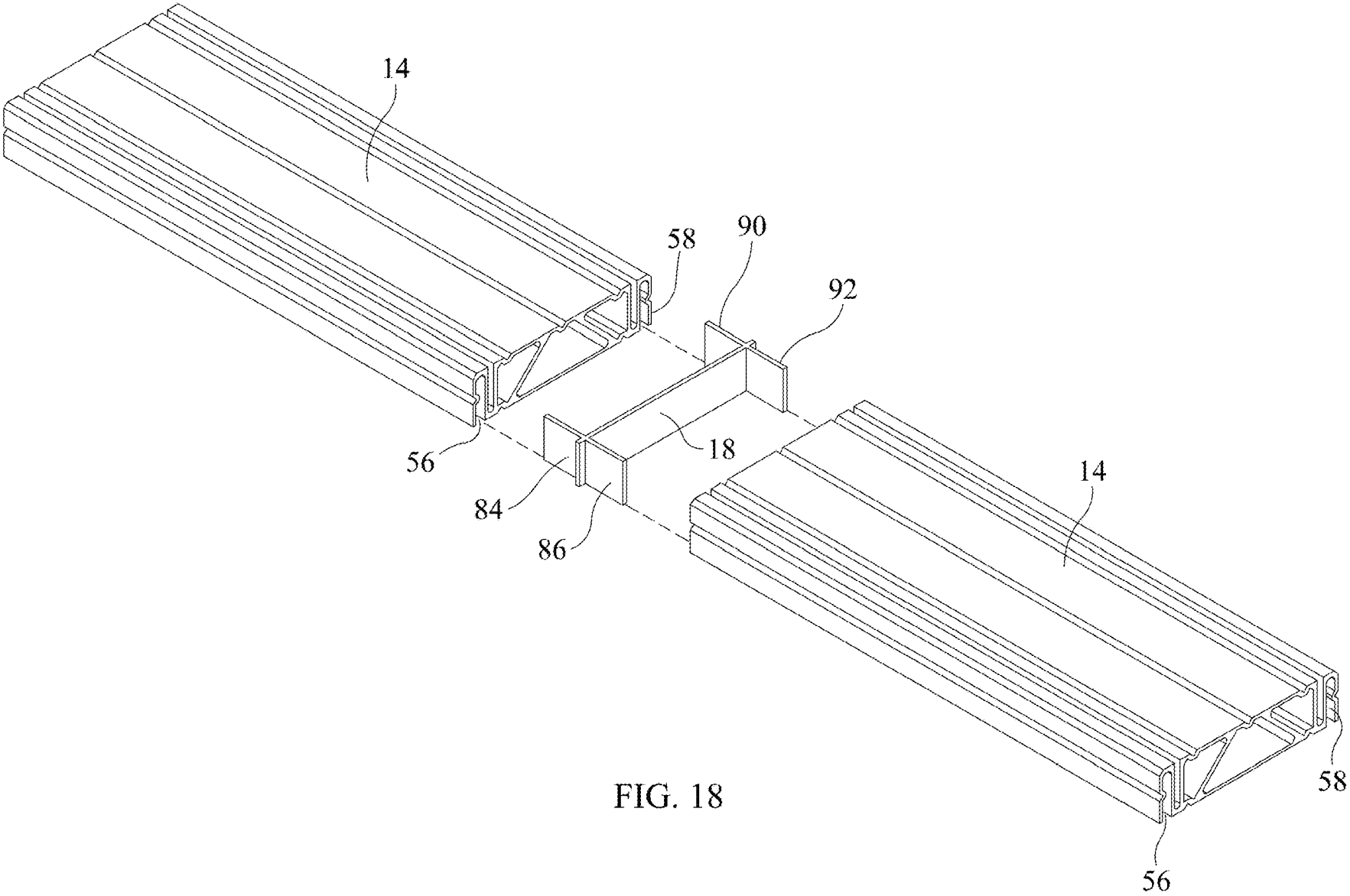
FIG. 18 diagrammatic illustration of two rail members being connected, end-to-end, by a first joint member in accordance with an aspect of the invention.

FIG. 18 diagrammatically illustrates two rail members 14 being connected, end-to-end, by joint member 18 in accordance with an aspect of the invention. In an aspect, this connection is used to join the end of rail members 14 to increase the overall length of a sill or top plate of a wall. In this connection, the flanges on one side of joint member 18 are received by slots 56 and 58 of one rail member, and the flanges on the opposite side of the joint member are received by slots 56 and 58 of the second rail member and secured by screws. The connection overcomes a disadvantage found is now existing FRP construction members as described above in which the connection is conventionally made by turning over a C-shaped channel member to lap the surfaces two other C-shaped channel members and which are then secured by screws extending through the thin webbing of the overlapped members.

Figure 19:
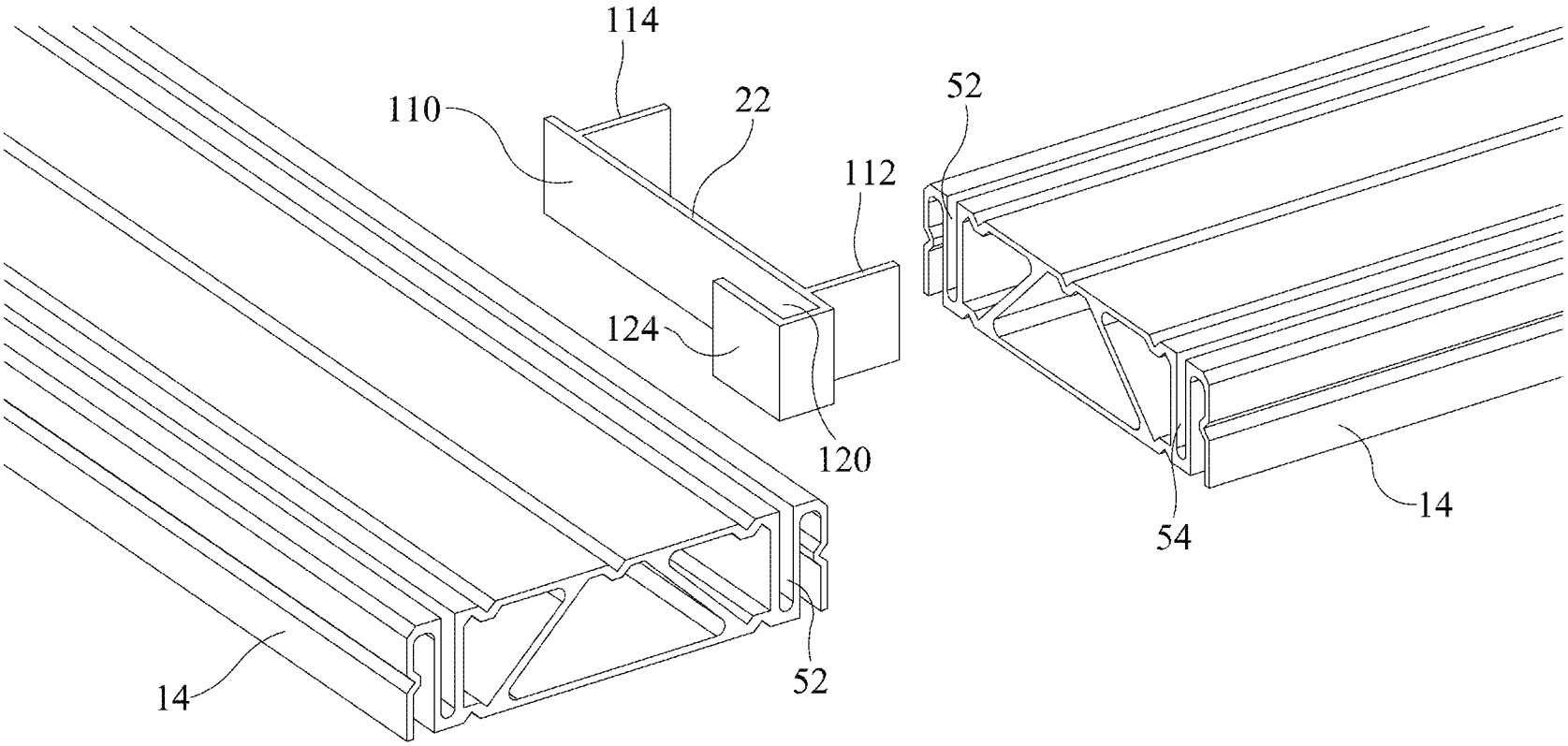
FIG. 19 is a first diagrammatic illustration showing two rail members being connected in a butt joint by a third joint member in accordance with an aspect of the invention.
Figure 20:
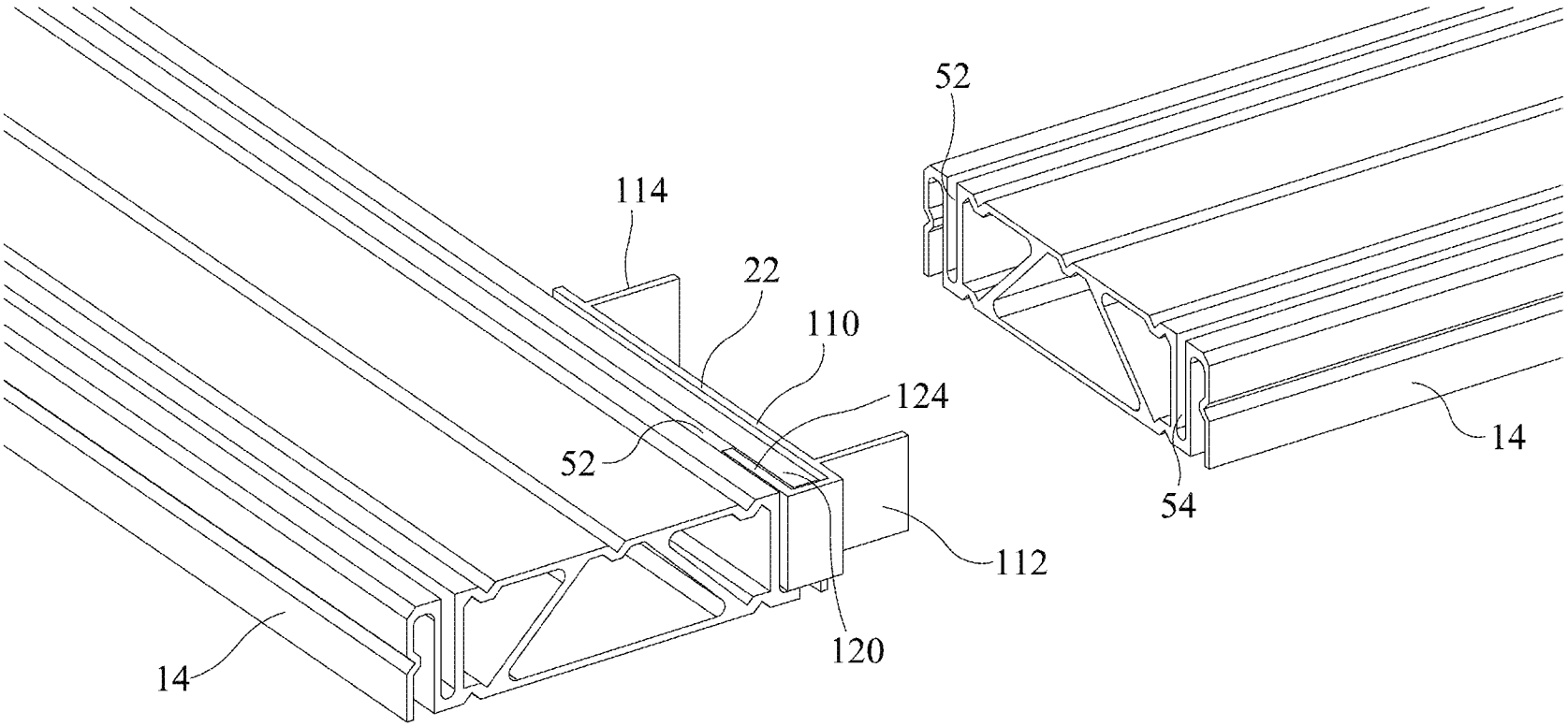
FIG. 20 is a second diagrammatic illustration showing two rail members being connected in a butt joint by a third joint member in accordance with an aspect of the invention.
Figure 21:
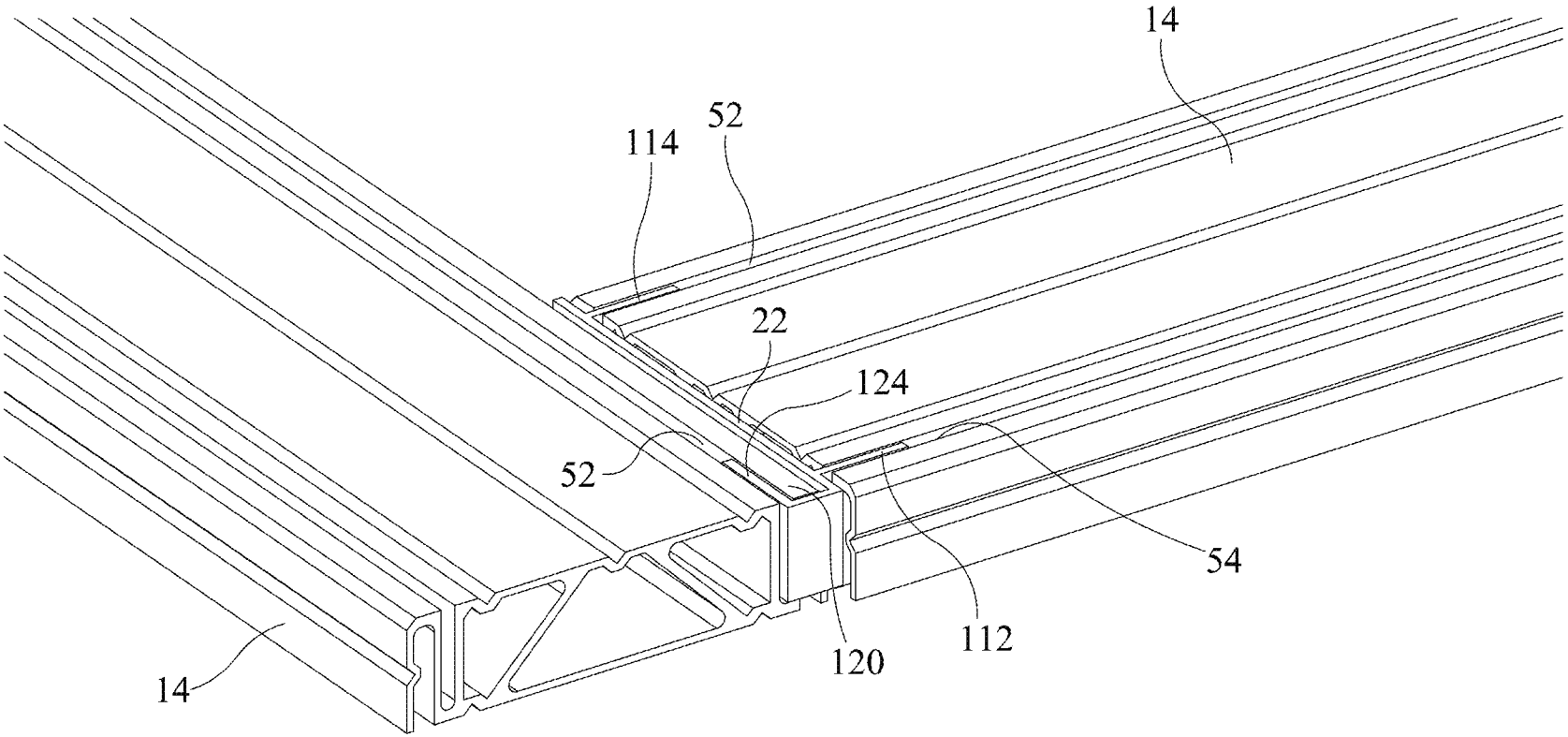
FIG. 21 is a third diagrammatic illustration showing two rail members being connected in a butt joint by a third joint member in accordance with an aspect of the invention.

FIGS. 19-21 diagrammatically illustrate a butt connection between two rail members 14 by joint member 22 in accordance with an aspect of the invention. In an aspect, this connection can be used to butt connect framed walls at a corner. As representatively shown, members 14 are arranged in a butt connection with the end of one member being abutted against the side of the other member and coupled by joint member 22. In an aspect, web 110 of joint member 22 is disposed along the side of the one rail member, with flange 24 being received by slot 54 and the end of the rail member being received by channel 120 of the joint member. Flanges 112 and 114 on the opposite side of joint member 22 are received by slots 52 and 54 through the end of the other joint member and screwed by screws. This butt connection overcomes a disadvantage found in now-existing FRP construction members as described above, in which a double top plate conventionally makes the connection by turning over a C-shaped channels member to lap the surfaces of two other C-shaped channel members and which are then secured by screws extending through the thin webbing of the overlapped members.

Figure 22:
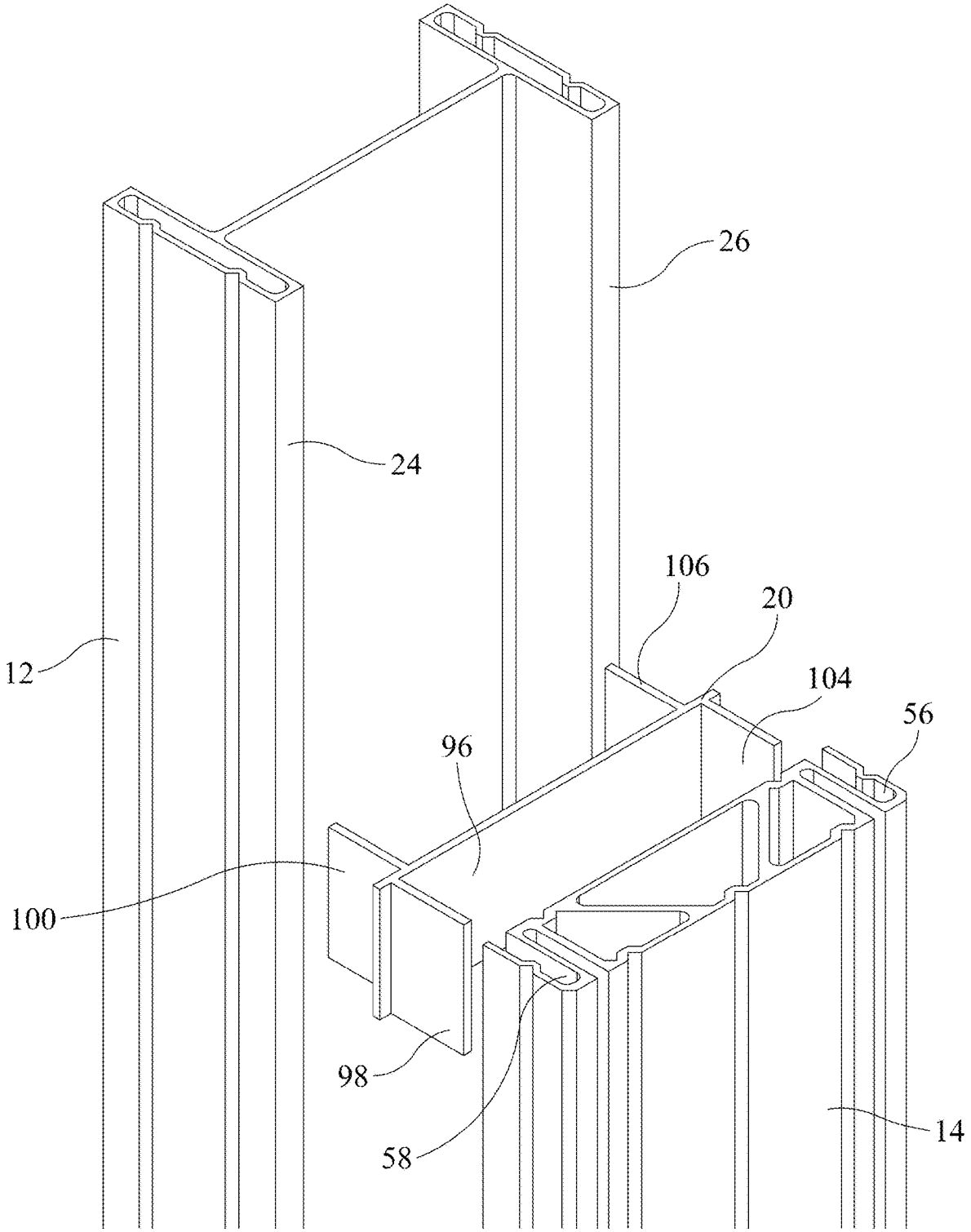
FIG. 22 is a first diagrammatic illustration showing a rail member configured as a jack stud being connected to a stud member in accordance with an aspect of the invention.
Figure 23:
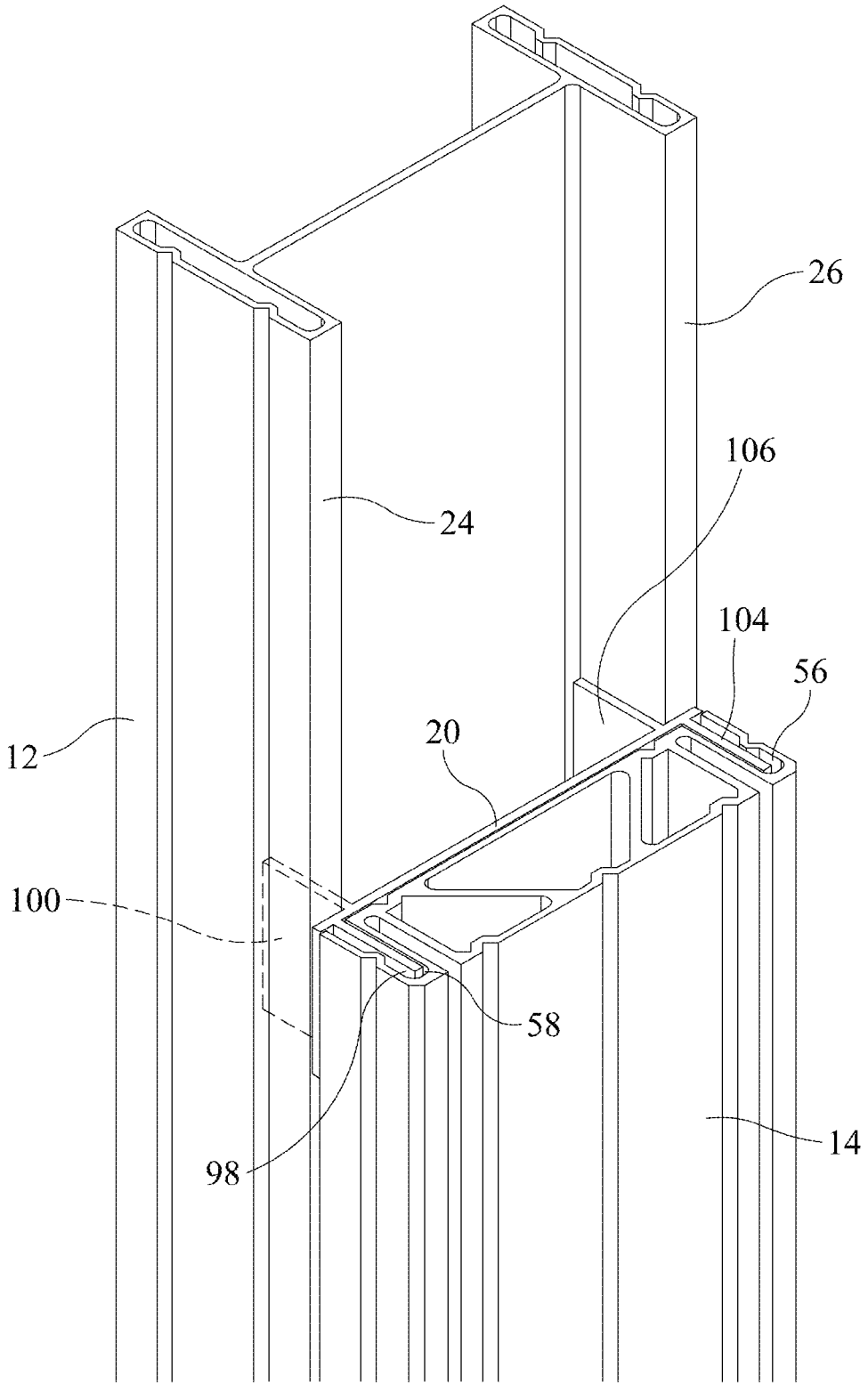
FIG. 23 is a second diagrammatic illustration showing a rail member configured as a jack stud being connected to a stud member in accordance with an aspect of the invention.

FIGS. 22 and 23 diagrammatically illustrate a jack stud being connected to a king stud in framing an opening in a wall in accordance with an aspect of the invention. As representatively shown, the king stud may be a stud member 12 and the jack stud may be a rail member 14 cut to a desired length. Rail member 14 (here a jack stud) is connected to stud member 12 (here a king stud) by joint member 20 at one end of the rail member. The joint member 20 connects rail member 14 and stud member, 12 with flanges 100 and 106 of the joint member, inserted between flanges 26 and 28 of the stud member, with the joint member extending across the width of the stud member. Flanges 98 and 104 of joint member 22 are received by slots 56 and 58 of rail member 14. Screws are used to secure the joint member to the stud member 12 and the rail member 14. One or more joint members 22 may be used along the length of the rail member to couple it with the stud member.

Figure 24:
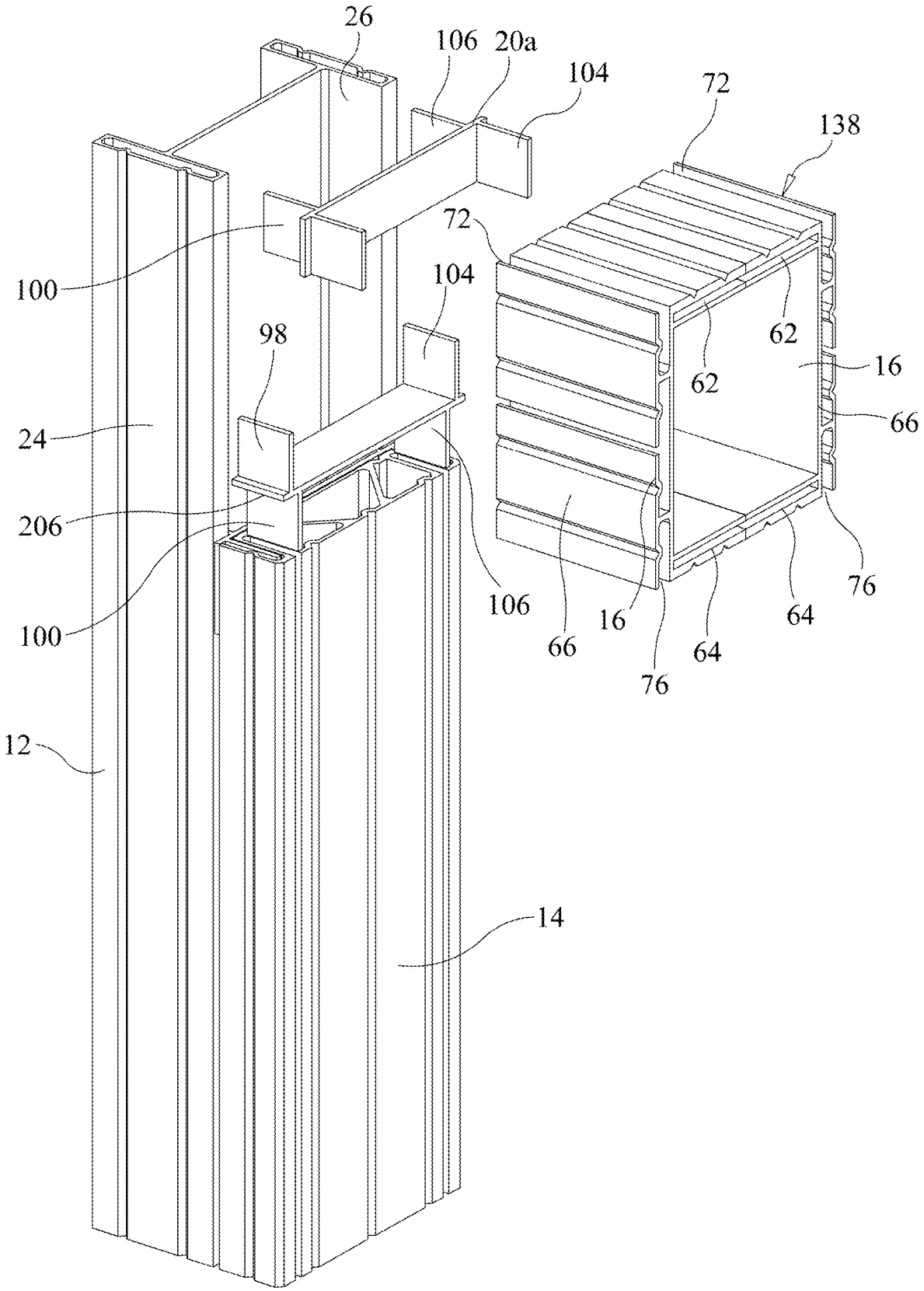
FIG. 24 is a first diagrammatic illustration showing two header members arranged to form a header and being connected to a stud member and a rail member configured as a jack stud in accordance with an aspect of the invention.
Figure 25:
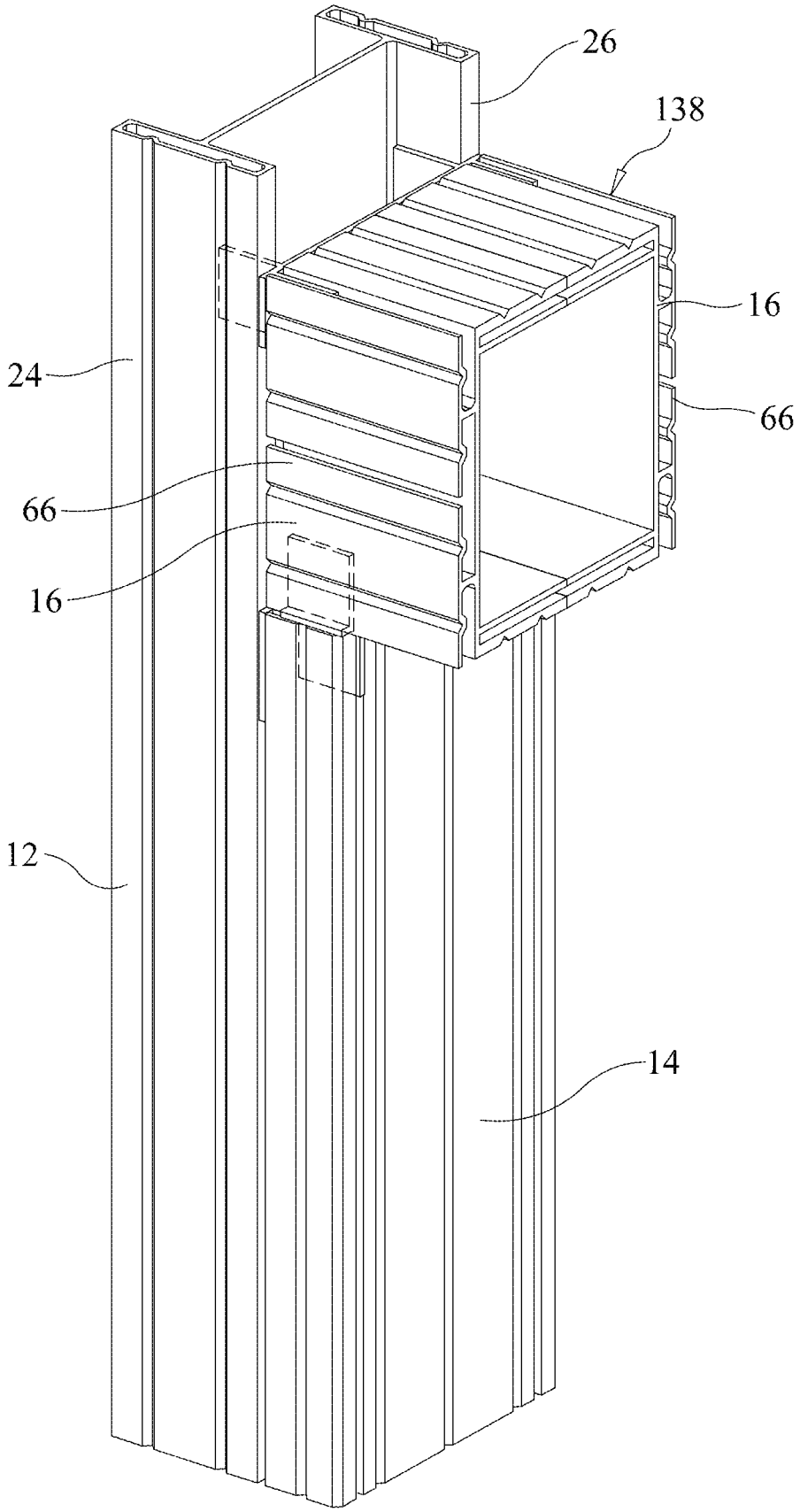
FIG. 25 is a second diagrammatic illustration showing two header members arranged to form a header and being connected to a stud member and a rail member configured as a jack stud in accordance with an aspect of the invention.

FIGS. 24 and 25 diagrammatically illustrate a header being connected to a king stud and a jack stud in framing an opening in a wall in accordance with an aspect of the invention. Header 138 is formed with two header members 16 that are arranged side-by-side along their lengths with the ends of flanges 62 and 64 abutted against one another, thereby forming a header beam, only portion of its length is shown here. Header members 16 are arranged with their webs 66 generally vertical and flush with flanges 24 and 26 of stud member 12. As representatively shown, two joint members, 20 (designated here as 20*a* and 20*b*), are used to secure the end of header 138, comprised of two header members, 16. One joint member, 20*a*, connects the header to stud member 12 (the king stud), and the other joint member, 20*b*, connects the header to rail member 14 (jack stud).

Joint member 20*a* connects the header to stud member 12 with its flanges 100 and 106 of the joint member, inserted between flanges 26 and 28 of the stud member, with the joint member extending across the width of the stud member. Flanges 98 and 104 of joint member 20*a* are received by either slot 72 or 76 (depending on orientation of the header members) of a respective header member 16 forming the header 138. Screws are used to secure joint member 20*a* to stud member 12 and header members 16. Joint member 20*b* connects the header to the end of member 14 with its flanges 98 and 104 of joint member 20*b* are received by either slot 72 or 76 (depending on orientation of the header member) of a respective header member 16. Flanges 100 and 106 of joint member 20*b* are received by slots 52 and 54 of the member 14. Screws are used to secure the joint member 20*b* to member 14 and the header members. Header 138 is connected at its opposite end to an opposing stud member and rail member in a similar manner as just described.

Figure 26:
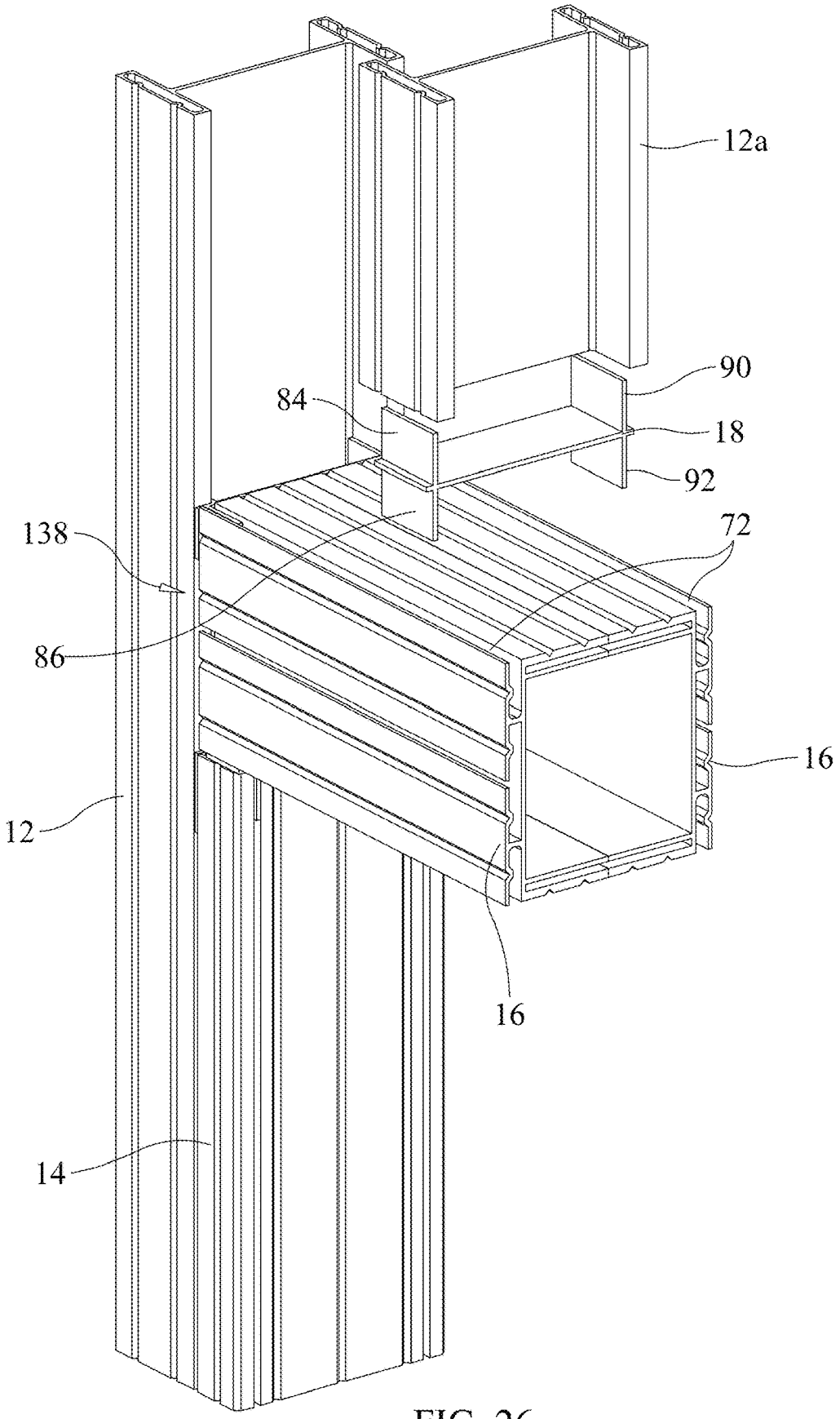
FIG. 26 is a diagrammatic illustration showing a stud member configured as a crippling stud being connected to a header comprising of two header members arranged to form the header.

FIG. 26 diagrammatically illustrates a cripple stud, representatively a top cripple stud, being connected to header in framing an opening in a wall in accordance with an aspect of the invention. Cripple stud, designated here as 12*a*, is a stud member 12 cut to length for attachment at one end to the header 138 and at its opposite end to a top rail (not shown). As representatively shown, a joint member 18 is used to connect the end of the cripple stud 12*a* to the top of header 138, comprising two header members 16. Flanges 84 and 90 are received by passages 30 and 36 of crippling stud 12*a* and flanges 86 and 92 are received by either slot 72 or 76 (depending on orientation of the header member) of a respective header member 16. Screws are used to secure the joint member 18 to the header members 16 and stud 12*a*. The other end of crippling stud 12*a* may be connected in a similar manner. Likewise other crippling studs whether top or bottom may be connected in a similar manner.

It will be appreciated by persons skilled in the art that the present embodiment is not limited to what has been particularly shown and described hereinabove. A variety of modifications and variations are possible in light of the above teachings without departing from the scope of the disclosure.

What is claimed is:

1. A fiber-reinforced polymer wall assembly, comprising:

at least two rail members, each rail member having a length, a first broad planar surface, an opposite second broad planar surface, a first side, an opposite second side, and first and second slots formed through the first broad planar surface and extend along the rail member;

at least one stud member, the stud member having opposite ends, a length extending between the opposite ends, a web and a pair of flanges on opposite sides of the web, each flange having a passage at the opposite ends;

wherein the stud member is extends between the rail members and is connected at its opposite ends to the rail members by a separate joint member at each end with the joint member disposed in the passages of the stud flanges and in the first and second slots of a respective rail member;

wherein an outermost surface of each flange of the stud member is flush with an outermost surface of each of the first and second sides of each rail member; and wherein the joint member has a web, first and second flanges extending in opposite directions from the web at a first end, and third and fourth flanges extending in opposite directions from the web at a second end.

2. The fiber-reinforced polymer wall assembly of claim 1, wherein each rail member further has third and fourth slots formed through the second surface and extending along the rail member.

3. The fiber-reinforced polymer wall assembly of claim 1, wherein the passages of the flanges of the stud member extend the entire length of the stud member between the opposite ends.

4. The fiber-reinforced polymer wall assembly of claim 1, wherein first and second slots formed through the first surface of the rail member extend the entire length of the rail member.

5. A fiber-reinforced polymer wall system, comprising:

a plurality of wall framing members comprising of rail members, stud members, and first joint members, wherein the rail members and stud members are connectable by the first joint members to frame a wall with the stud members attached to and extending between the rail members in spaced relationship along the rail members;

wherein each rail member has a length, a first broad planar surface, an opposite second broad planar surface, a first side, an opposite second side, and first and second slots formed through the first surface and extend along the rail member;

wherein each stud member has opposite ends, a length extending between the opposite ends, a web and a pair of flanges on opposite sides of the web, each flange having a passage extending along the length of the stud member; and wherein each first joint member has a web, first and second flanges extending in opposite directions from the web at a first end, and third and fourth flanges extending in opposite directions from the web at a second end, and wherein the first joint members are configured to connect the ends of the stud members to the rail members.

6. The fiber-reinforced polymer wall system of claim 5, further comprising:

second joint members, each second joint member having a central web and first and second flanges extending in opposite directions from the web at a first end, and third and fourth flanges extending in opposite directions from the web at a second end, the first and third flanges are disposed on the central web in an inward position from the first and second ends of the central web, respectively, and the second and fourth flanges are disposed on the central web in an inward position from first and second ends of the central web, respectively, at greater distance than first and third flanges such that second and fourth flanges are inwardly offset from first and third flanges.

7. The fiber-reinforced polymer wall system of claim 5, further comprising:

third joint members, each third joint member having a web, first and second flanges extending in a same direction from the web, the first flange inwardly disposed from a first end, the second flange inwardly disposed from a second end, and channel disposed on a side of the web opposite the first and second flanges that is defined by first and second walls attached to the web.

8. The fiber-reinforced polymer wall system of claim 5, wherein the plurality of framing members further has header members, each header member has a pair of legs extending outwardly in a same direction from opposite ends of a web, a first slot formed through a first leg of the pair of legs and extends along a length of the header, a second slot formed through a second leg of the pair of legs and extends along the length of the header, a first channel formed in the web through a first outward facing side in a direction perpendicular to the first leg and extends along the length of the header, and a second channel formed in the web through a second outward facing side in a direction perpendicular to the second leg and extends along the length of the header.

9. The fiber-reinforced polymer wall system of claim 5, wherein each rail member further has third and fourth slots formed through the second surface and extending along the rail member.

10. The fiber-reinforced polymer wall system of claim 5, wherein the passage of each flange extends the entire length of the stud member between the opposite ends thereof.

11. The fiber-reinforced polymer wall system of claim 5, wherein the first and second slots formed through the first broad planar surface of the rail member extend the entire length of the rail member.

12. The fiber-reinforced polymer wall system of claim 5, wherein the rail members can be configured as either a top plate or a bottom plate of a wall frame or can be configured as a jack stud or sill plate.

* * * * *